US006662852B2

(12) United States Patent
Gegel

(10) Patent No.: US 6,662,852 B2
(45) Date of Patent: Dec. 16, 2003

(54) MOLD ASSEMBLY AND METHOD FOR PRESSURE CASTING ELEVATED MELTING TEMPERATURE MATERIALS

(75) Inventor: Gerald A. Gegel, Morton, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/178,581

(22) Filed: Jun. 24, 2002

(65) Prior Publication Data

US 2002/0166649 A1 Nov. 14, 2002

Related U.S. Application Data

(62) Division of application No. 09/397,193, filed on Sep. 16, 1999, now abandoned.

(51) Int. Cl.[7] ..... B22D 19/00
(52) U.S. Cl. ..... 164/98; 164/120
(58) Field of Search ..... 164/98, 120, 119

(56) References Cited

U.S. PATENT DOCUMENTS 3,615,880 A * 10/1971 Barto et al. ..... 148/545
4,614,630 A * 9/1986 Pluim, Jr. ..... 264/219
5,163,498 A * 11/1992 Kantner et al. ..... 164/97
5,385,195 A * 1/1995 Bell et al. ..... 164/66.1
5,407,495 A * 4/1995 Rohatgi ..... 148/522

FOREIGN PATENT DOCUMENTS

JP 9-277218 * 10/1997

* cited by examiner

*Primary Examiner*—M. Alexandra Elve
*Assistant Examiner*—Len Tran

(57) ABSTRACT

An impermeable ceramic mold is disposed within a steel die and used in a process for pressure casting of elevated melting temperature alloys and pressure infiltration casting of elevated melting temperature alloys having wear resistant particles, included therewith. The ceramic mold provides an insulation layer between the molten metal and the steel die, and prevents welding between the molten metal and the die. The alloy steel die encloses the ceramic mold and provides the strength needed to resist the pressures generated during pressure infiltration casting.

13 Claims, 1 Drawing Sheet

MOLD ASSEMBLY AND METHOD FOR PRESSURE CASTING ELEVATED MELTING TEMPERATURE MATERIALS

This application is a divisional of application Ser. No. 09/397,193 filed Sep. 16, 1999, now abandoned.

TECHNICAL FIELD

This invention relates generally to a mold assembly and method for pressure casting elevated melting temperature alloys and pressure infiltration casting metal matrix composite structures, and more particularly to such a mold assembly having both ceramic and metal components and to a method of hybrid casting using a mold assembly having both ceramic and metal components.

BACKGROUND ART

Pressure casting, also commonly referred to as squeeze casting, has long been advocated as the ideal process for the production of metal matrix composite (MMC) castings, and as a method of eliminating porosity in cast alloys. However, heretofore pressure casting of liquid metal alloys has been generally limited to relatively low melting temperature alloys, such as aluminum. A common problem when casting relatively higher melting temperature alloys has been the tendency of the higher melting temperature alloys to at least partially bond, i.e., weld, to the surface of a metal die in which the higher melting temperature alloy is cast.

An example of pressure casting of relatively low melting temperature metal alloys is described in U.S. Pat. No. 5,511,603 issued Apr. 30, 1996 to Alexander M. Brown, et al and entitled MACHINABLE METAL-MATRIX COMPOSITE AND LIQUID METAL INFILTRATION PROCESS FOR MAKING SAME. In the Brown, et al process, metal matrix composites are formed by pressure casting in which the pressure is supplied by an inert gas, such as argon, and the structure is cast into a previously evacuated ceramic mold. The ceramic mold was coated with a graphite coating and then lined with graphite paper prior to heating and casting of the molten metal.

The present invention is directed to overcoming the problems set forth above. It is desirable to have a mold assembly, and method of casting, in which relatively high, i.e., elevated melting temperature alloys, can be cast. It is also desirable to have such a mold assembly and method that does not require the application of special coatings and linings to the mold, which could disadvantageously modify the surface chemistry of elevated melting temperature materials. It is also desirable to have a mold assembly and method of casting that does not require a pressurized inert gas atmosphere. Moreover, it is desirable to have a mold assembly and method of squeeze, or pressure, casting of elevated melting temperature alloys, both ferrous and nonferrous, which provide porosity-free, near net-shape cast components. In addition, it is desirable to have a mold assembly and method of pressure infiltration casting of elevated melting temperature alloys, both ferrous and nonferrous, into loose or loosely held ceramic or cermet particles, porous preforms made of ceramic or cermet powders, and monolithic preforms made of ceramic or cermet powders.

DISCLOSURE OF THE INVENTION

In one aspect of the present invention, a mold assembly suitable for pressure infiltration casting elevated melting temperature alloys and metal matrix composite structures includes a liquid metal impermeable ceramic mold disposed within a steel die. The liquid metal impermeable ceramic mold has an inner surface that defines the external shape of an article cast in the ceramic mold, and an outer shape that substantially conforms to the inner surface of a steel die. Ideally the wall thickness of the ceramic mold would be from about 2 mm to about 6 mm. The ceramic mold also has an opening formed in an upper portion that is adapted to receive a pressure-actuated punch therein having a ceramic cap disposed on a distal end of the punch. The steel die has an inner surface which encloses and mates with the outer surface of the ceramic mold whereby the steel die intimately supports the ceramic mold within the internal cavity.

In another aspect of the present invention, a mold assembly for pressure casting elevated temperature metal alloys and metal matrix composite structures, includes a liquid metal impermeable ceramic mold, as defined above in the previously described aspect of the present invention, a granular support media surrounding the ceramic mold in intimate contact with the outer surface of the ceramic mold, and a steel die. The steel die has an inner surface defining an internal cavity shaped to support the granular support media therein and has an opening formed in an upper portion adapted to receive a low pressure punch reciprocatably movable between the outer surface of the ceramic mold and the inner surface of the steel die whereby the granular support media is maintained in a compressed state within the internal cavity of the steel die.

Other aspects of the present invention include the punch received through the opening in the upper portion of the ceramic mold having a ceramic cap disposed on a distal end of the punch. Another feature of the mold assembly embodying the present invention includes the granular support media being either metallic or non-metallic particles.

In another aspect of the present invention, a method of forming porosity-free, near net-shape articles containing elevated melting temperature alloys includes providing a liquid metal impermeable ceramic mold having a wall thickness from about 2 mm to about 6 mm and an opening disposed in a top portion adapted to receive a punch member therethrough, heating the ceramic mold to a temperature substantially equal to 1000° C. (1832° F.), and providing an alloy steel die having an internal cavity adapted to receive the ceramic mold therein. The method further includes heating the alloy steel die to a temperature substantially equal to 260° C. (500° F.), inserting the heated ceramic mold into the internal cavity of the heated alloy steel die, and pouring a molten elevated melting temperature metal into the ceramic mold. The method then includes lowering the punch member through the opening in the upper portion of the ceramic mold, thereby bringing the punch member into intimate contact with the molten metal poured into the ceramic mold. The lowering of the punch is continued so as to create pressure on the molten metal sufficient to form an essentially porosity-free article having a net shape defined by the internal surface of the ceramic mold. The alloy steel die, the ceramic mold and the metal cast in the mold is then cooled, thereby forming a solidified cast article in the mold, after which the solidified cast article is removed from the mold.

Other features of the method of forming porosity-free, near net-shape articles, includes inserting a wear-resistant material into the mold prior to pouring a molten elevated melting temperature metal into the mold. Another feature includes preheating the wear-resistant insert or preform, prior to inserting the wear-resistant material into the mold. Other features include the wear-resistant material comprising wear-resistant fibers, wear-resistant particles, or a preformed monolithic article, having either a porous or solid structure.

Still other features of the method of forming porosity-free, near net shape article, in accordance with the present invention, includes pouring a molten elevated melting temperature metal into the ceramic mold in which the metal has a melting temperature of at least 900° C. (1652° F.). Examples of such elevated melting temperature metals includes gray iron and low alloy steel.

Yet another feature of the method of forming porosity-free, near net-shaped articles, in accordance with the present invention, includes the step of cooling the alloy steel die, the ceramic mold, and the metal alloy cast in the mold in such a manner as that the first cooled portions of the die, mold, and cast metal alloy, are spaced furthest from the punch member. The die, mold, and cast alloy are then sequentially cooled from the portions first cooled toward an interface between the cast metal alloy and the punch member, thereby causing directional solidification of the cast article.

BRIEF DESCRIPTION OF THE DRAWINGS

A more complete understanding of the structure and operation of the present invention may be had by reference to the following detailed description when taken in conjunction with the accompanying drawings, wherein.

BEST MODE FOR CARRYING OUT THE INVENTION

Figure 1:
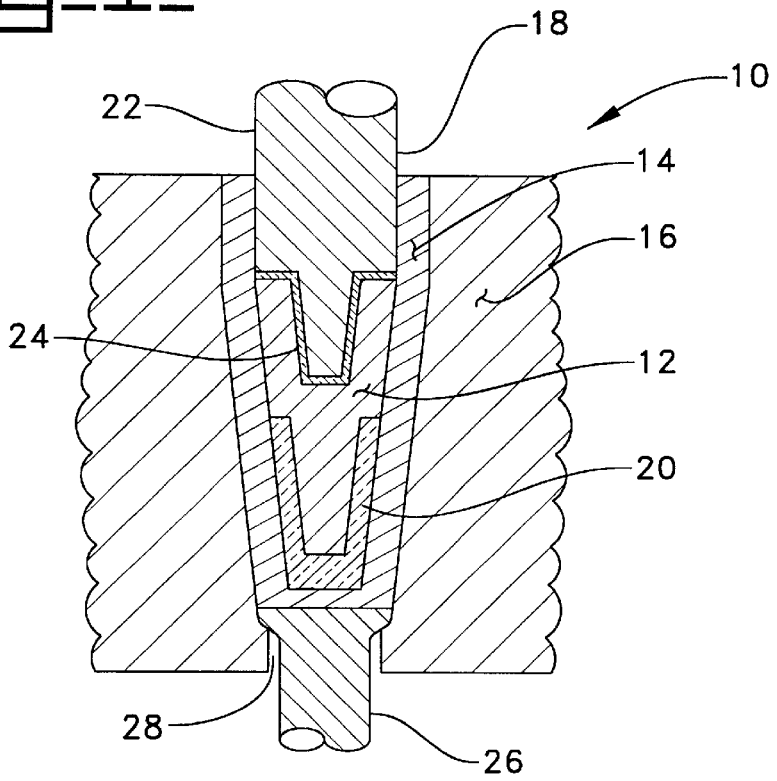
FIG. 1 is a schematic cross-sectional view of a mold assembly illustrating one embodiment of the present invention.

In a first preferred embodiment, illustrated in FIG. 1, a mold assembly embodying the present invention is generally indicated by the reference numeral 10. The mold assembly 10 includes a ceramic mold 14, similar to that used in investment casting, which defines an inner cavity of a shape and size needed to form a near-net-shape cast article 12. In an illustration of the first preferred embodiment, the cast article 12, shown in somewhat schematic fashion in FIG. 1, is a tooth for a ground engaging tool, such as a bucket or ripper.

The ceramic mold 14 is preferably liquid metal impermeable, to restrict infiltration of the molten metal material cast in the mold into the mold itself, and may be made from a material such as fused silica which may also be used for the first dip coats when making investment casting molds. Unlike investment casting molds, the ceramic mold 14 of the present invention does not have stucco layers. Desirably, the wall of the ceramic mold 14 is relatively thin, having a thickness of from about 2 mm (5/64 inch) to about 6 mm (¼ inch). The wall thickness of the ceramic mold 14 is such that it provides sufficient insulation between the molten material poured into the cavity of the mold 14 to prevent melting or fusion of an alloy steel die 16 in which the ceramic mold 14 is disposed, but still allows controlled rapid cooling of the cast article 12 after casting.

In the first-described embodiment, the alloy steel die 16 has an internal cavity shaped to mate with the outer surface of the ceramic mold 14 so that the alloy steel die 16 intimately supports the ceramic mold 14. The ceramic mold 14 also has an opening 22 formed at the upper end of the ceramic mold 14 that is adapted to receive a mechanically pressure-actuated punch 18 therein. Desirably, the steel die 16 and steel punch 18 are formed of a tool steel having a tempering temperature sufficient to resist softening during the casting process described below. Also, the distal end of the punch 18 may be shaped to form a defined feature of the cast article 12, such as a mounting socket. Preferably, a ceramic cap 24 covers the lower end of the punch 18 to further protect the punc 18 during the casting process. An opening in the bottom of the steel die 16 provides access for an ejector 26 extending through the bottom of the steel die 16 to push the ceramic mold 14 and the cast article 12 out of the steel die 16 after solidification of the cast article 12.

The cast article 12 may consist of a composite structure having wear-resistant particles 20 dispersed or selectively located within the elevated melting temperature alloy. The wear-resistant materials 20 may be in the form of one or more preforms made of ceramic or cermet fiber or particulate wear-resistant materials, such as tungsten carbide, aluminum oxide, titanium carbide and titanium diboride, or one or more monolithic wear-resistant components. The elevated melting temperature alloy, for example, gray iron or low alloy steel, infiltrates the loose particles or fibers or preforms to produce a nonporous near-net shape cast article 12.

In summary, in the first preferred embodiment of the present invention, the ceramic mold 14 defines the shape of a cast article 12, provides an insulation layer between the molten metal and the alloy steel die 16, and prevents alloying or welding between the cast molten metal and the alloy steel die 16. The alloy steel die 16 encloses the ceramic mold 14 and provides the strength needed to resist the pressure generated during pressure infiltration casting.

Figure 2:
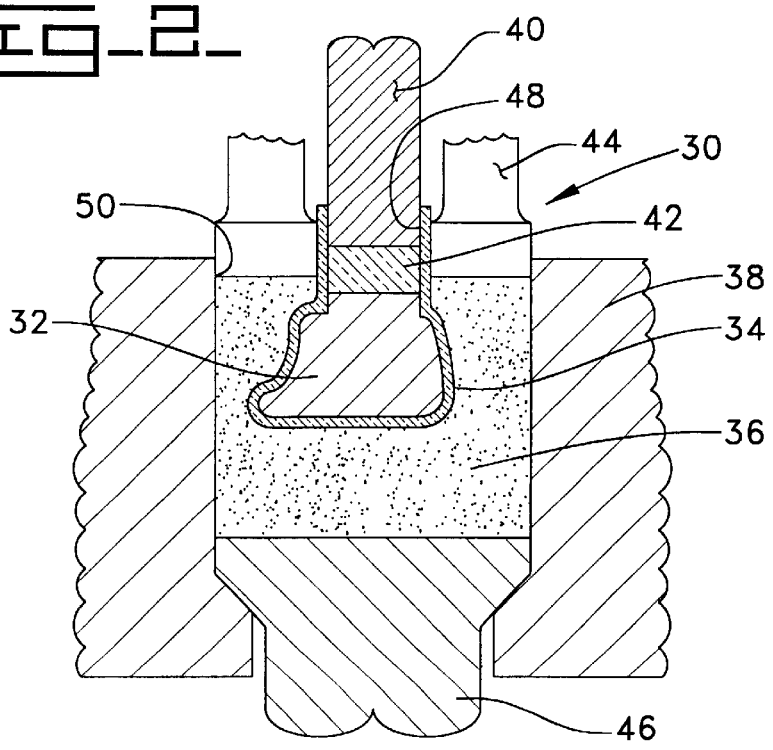
FIG. 2 is a schematic cross-sectional view of a mold assembly illustrating a second embodiment of the present invention.

In a second preferred embodiment of the present invention, illustrated in FIG. 2, a mold assembly 30 includes a ceramic mold 34, formed as described above with respect to the first preferred embodiment, which is supported within a granular support media 36, zircon sand, graphite, or synthetic mullite such as silica sand. In this arrangement, the steel die 38, may be formed of a relatively lower temperature steel such as tool steel and can have a more general shape rather than the internal shape of the first embodiment die 16 which is adapted to intimately support the outer surface of the ceramic mold. As in the previously described ceramic mold 14, the ceramic mold 34 likewise has an opening 48 disposed in an upper portion which is adapted to receive a high pressure punch 40 therein. Desirably, the high pressure punch 40 has a ceramic cap 42 disposed on the distal end of the punch 40 to provide insulation between the molten material and the metal portion of the punch 40.

The steel die 38 also has an opening 50 disposed at an upper end that is adapted to receive a low pressure punch 44 that is reciprocatably movable between the outer surface of the ceramic mold 34 and the inner surface of the opening 50 of the steel die 38, for the purpose of compacting the granular media 36 and maintaining the granular media 36 in a compressed state within the internal cavity of the steel die 38. The compressed granular media 36 provides the strength to resist the lateral or radial pressures generated in the ceramic mold 34 during casting.

Also, as in the above-described arrangement, an opening in the bottom of the steel die 38 provides access for an ejector 46 positioned at the bottom of the steel die 38, to push the granular support media 36, the ceramic mold 34, and the cast article 32 out of the steel die 38 after solidification of the cast article 32.

The mold assemblies described above have been used experimentally to pressure cast gray iron and low alloy steel, and pressure infiltration cast WC-7Co, alumina and FeWTic, particles and WC-7Co/4640 and FeWTic/4640 sintered preforms with gray iron and low alloy steel. For these experiments, the ceramic molds 14, 34 were used both as fabricated. No infiltration of gray iron, low alloy steel, or wear-resistant particles into the mold 14, 34 was observed, and there was no observable damage to either of the steel dies 16, 18 at pressures applied by the high pressure punch of up to about 27,600 kN/m$^2$ (4,000 psi).

A method for forming porosity-free, near net shape articles, containing elevated melting temperature alloys, in accordance with the present invention, includes first providing a liquid metal impermeable ceramic mold 14, 34 having a wall thickness of from about 2 mm (5⁄64 inch) to about 6 mm (¼ inch). A steel die 16, 38 to receive the ceramic mold 14, 34 is also provided. Both the ceramic mold 14,34 and the steel die 16, 38 are heated and the heated ceramic mold 14, 34 is placed into the preheated steel die 16, 38. Preferably, the ceramic mold 14, 34 and steel die 16, 38 are preheated to a temperature that is below the melting temperature of the alloy being cast, but is sufficient to prevent premature cooling of the molten metals, for example, when casting gray iron the ceramic mold 14, 34 and steel die 16, 38 were heated to a temperature of about 1000° C. (1832° F.) and 260° C. (500° F.) respectively. In addition, the granular support media 36 may be heated to temperatures up to 1200° C. (2200° F.).

The molten elevated melting temperature alloy is then poured into the mold and the punch 18, 40 is lowered through the opening 22, 48 in the upper portion of the mold 14, 34. Sufficient pressure is applied by the punch 18, 40 to exhaust any trapped gases or voids from the mold 14, 34 and produce an essentially porosity-free cast article 12, 32. As noted above, punch pressures of up to 27,600 kN/m$^2$ (4,00 psi) have been successfully applied with no adverse effect on the punch mold or die.

If granular support media 36 is disposed between the ceramic mold 34 and the steel die 38, the low pressure punch 44 is lowered through the opening 50, 38 and the granular support media 36 compacted to a pressure sufficient to provide support for the ceramic mold 34 within the steel die 38. Pressure on the low pressure punch member 44 is maintained during the casting operation, to assure that support for the mold 34 is also maintained during casting.

The steel die 16, 38, the ceramic mold 14, 34, and the metal cast in the mold are subsequently cooled, thereby forming a solidified cast article 12, 32 in the mold. Cooling of the die, mold, and cast article is desirably carried out by first cooling the bottom of the assembly 10, 30, i.e., the portions of the assembly 10, 30 that are spaced furthest from the punch 18, 40, then sequentially and progressively cooling from the first cooled portions toward the interface between the cast metal alloy and the punch member 18, 40, thereby resulting in directional solidification of the cast article 12, 32.

Lastly, the solidified cast article 12, 32 is removed from the mold 14, 34. Experimental articles, comprising gray iron and low alloy steel, with WC-7Co particles and gray iron and low alloy steel, with WC-7Co/4640 sintered preforms, were cast in accordance with the above-described procedures were carefully examined after removal from the mold, and exhibited an essentially porosity free structure. Composite structures (MMC) were thus formed in accordance with the present invention as described above, and showed complete infiltration of the elevated melting temperature metal (gray iron and low alloy steel) into the wear-resistant particle structure. From the experiments conducted using the first described mold assembly 10 embodying the present invention, it is believed that other metals, in addition to gray iron and low alloy steel, could be successfully pressure cast and form either porosity free solid structures or metal matrix composite structures. The method embodying the present invention appears to be particularly beneficial in infiltration casting of elevated melting temperature metals in which the metal has a melting temperature of at least about 900° C. (1652° F.).

Industrial Applicability

The mold assembly 10, 30 and the described method of pressure infiltration casting using the mold assemblies 10, 30 is particularly beneficial in the squeeze or pressure casting of elevated melting temperature alloys, both ferrous and nonferrous based, to fabricate porosity free near net-shape components. In particular, articles having high wear resistance are advantageously formed by the above-described process.

In addition, pressure infiltration casting of elevated melting temperature alloys, both ferrous and non-ferrous based, into loose or loosely held ceramic/or cermet particles, porous preforms made from ceramic or cermet powders, and monolithic preforms made from ceramic or cermet powders are readily carried out using the method and mold assembly embodying the present invention. The problems of mold degradation, infiltration of high melting temperature metals into a ceramic mold, and welding, or fusion, of portions of the cast material to a metal die, are avoided.

Although the present invention is described in terms of preferred exemplary embodiments, with specific illustrative mold shapes and cast materials, those skilled in the art will recognize that changes in those specific shapes and cast materials may be made without departing from the spirit of the invention. Such changes are intended to fall within the scope of the following claims. Other aspects, features, and advantages of the present invention may be obtained from the study of this disclosure and the drawings, along with the appended claims.

What is claimed is:

1. A method of forming porosity-free, near net shape articles containing elevated melting temperature alloys, comprising:

providing a liquid metal impermeable ceramic mold having a wall thickness defined by internal and external surfaces spaced from each other by a distance of from about 2 mm to about 6 mm and an opening disposed in an upper portion adapted to tightly receive a punch member therethrough;

heating said ceramic mold;

providing an alloy steel die having an internal cavity adapted to receive said ceramic mold therein;

heating the alloy steel die;

inserting the heated ceramic mold into the internal cavity of the alloy steel die;

pouring a molten elevated melting temperature metal into the ceramic mold;

lowering the punch member through the opening in the upper portion of the ceramic mold, bringing said punch member into intimate contact with the molten metal poured into the ceramic mold;

continue lowering the punch member to create pressure on said molten metal sufficient to form an essentially porosity-free article having a net shape defined by the internal surface of the ceramic mold;

cooling the alloy steel die, the ceramic mold, and the metal cast in the mold, thereby forming a solidified cast article in the mold; and, removing the solidified cast article from the mold.

2. The method of forming porosity-free, near net shape articles, as set forth in claim 1, wherein said method includes inserting a wear resistant material into the mold prior to said pouring a molten elevated melting temperature metal into the ceramic mold.

3. The method of forming porosity-free, near net shape articles, as set forth in claim 2, wherein said wear resistant material is preheated to a temperature of about 1000° C. (1832° F.) prior to insertion into the mold.

4. The method of forming porosity-free, near net shape articles, as set forth in claim 2, wherein said wear resistant material is a preformed article containing wear resistant fibers.

5. The method of forming porosity-free, near net shape articles, as set forth in claim 2, wherein said wear resistant material is a preformed article containing wear resistant particles.

6. The method of forming porosity-free, near net shape articles, as set forth in claim 2, wherein said wear resistant material is a preformed monolithic article formed of a wear resistant material.

7. The method of forming porosity-free, near net shape articles, as set forth in claim 2, wherein said wear resistant material is a preformed porous monolithic article formed of a wear resistant material.

8. The method of forming porosity-free, near net shape articles, as set forth in claim 1, wherein said pouring a molten elevated melting temperature metal into the ceramic mold includes pouring a metal having a melting temperature of at least 900° C. (1652° F.).

9. The method of forming porosity-free, near net shape articles, as set forth in claim 8, wherein said metal is gray iron.

10. The method of forming porosity-free, near net shape articles, as set forth in claim 8, wherein said metal is low alloy steel.

11. The method of forming porosity-free, near net shape articles, as set forth in claim 1, wherein said cooling the alloy steel die, the ceramic mold, and the metal alloy cast in the mold includes first cooling portions of the die, mold and cast metal alloy that are spaced furthest from the punch member, then cooling the die, mold and cast metal alloy sequentially from the portions first cooled toward an interface between the cast metal alloy and the punch member, thereby causing directional solidification of the cast article.

12. The method of claim 1, wherein the step of heating said ceramic mold includes heating the ceramic mold to a temperature of about 1000° C. (1832° F.).

13. The method of claim 1, wherein the step of heating the alloy steel die includes heating the alloy steel die to a temperature of about 260° C. (500° F.).

* * * * *